US007600754B2

(12) United States Patent
Sato

(10) Patent No.: US 7,600,754 B2
(45) Date of Patent: Oct. 13, 2009

(54) IMAGE READING APPARATUS

(75) Inventor: Kenji Sato, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 351 days.

(21) Appl. No.: 11/487,451

(22) Filed: Jul. 17, 2006

(65) Prior Publication Data

US 2007/0019973 A1 Jan. 25, 2007

(30) Foreign Application Priority Data

Jul. 19, 2005 (JP) ..... 2005-207984
May 1, 2006 (JP) ..... 2006-127171

(51) Int. Cl.
*B65H 5/34* (2006.01)

(52) U.S. Cl. ..... 271/270

(58) Field of Classification Search ..... 271/270
See application file for complete search history.

(56) References Cited

U.S. PATENT DOCUMENTS 5,018,716 A * 5/1991 Yoshida et al. ..... 271/227
6,298,778 B1 * 10/2001 Onodera et al. ..... 101/232
6,650,436 B1 * 11/2003 Hamamoto et al. ..... 358/1.9
6,782,812 B2 * 8/2004 Hasegawa et al. ..... 101/128.4
6,872,018 B2 * 3/2005 Jung ..... 400/578
6,892,043 B2 * 5/2005 Hayashi et al. ..... 399/208
2002/0122678 A1 * 9/2002 Chapman et al. ..... 399/302
2004/0047654 A1 * 3/2004 Hayashi et al. ..... 399/208
2004/0165897 A1 * 8/2004 Hooper et al. ..... 399/44
2004/0222068 A1 * 11/2004 Meyer et al. ..... 198/750.2
2005/0036797 A1 * 2/2005 Miura ..... 399/44
2005/0152710 A1 * 7/2005 Camp et al. ..... 399/68
2007/0126837 A1 * 6/2007 Takahashi et al. ..... 347/104
2007/0261581 A1 * 11/2007 Kumar ..... 101/484
2007/0297820 A1 * 12/2007 Shirakata ..... 399/44
2008/0011171 A1 * 1/2008 Schneider et al. ..... 101/350.1
2008/0157462 A1 * 7/2008 Ohta ..... 271/110
2008/0252000 A1 * 10/2008 Dochi ..... 271/264

FOREIGN PATENT DOCUMENTS

JP 2002-284388 10/2002

* cited by examiner

*Primary Examiner*—Patrick H Mackey
*Assistant Examiner*—Howard Sanders
(74) *Attorney, Agent, or Firm*—Oblon, Spivak, McClelland, Maier & Neustadt, L.L.P.

(57) ABSTRACT

The present invention provides an image reading apparatus which controls conveyance of an original in accordance with the temperature of a conveyance roller for conveying the original, and which performs appropriate conveyance by determining the presence of an abnormality in a temperature detection operation. A copying apparatus uses a temperature detection sensor to detect the temperature of an outlet conveyance roller for conveying an original, which is driven to rotate by a stepping motor, and adjusts the speed at which the original is conveyed by the outlet conveyance roller to a predetermined basic conveyance speed by controlling the rotation of the stepping motor on the basis of a detection signal of the temperature detection sensor. Further, the presence of an abnormality in the detection signal of the temperature detection sensor is determined, and if an abnormality is present, conveyance speed adjustment is halted.

16 Claims, 5 Drawing Sheets

| TEMPERATURE (°C) | VOLTAGE (V) |
|---|---|
| 0 | 4.0 |
| 1 | 3.98 |
| 2 | 3.96 |
| ... | ... |
| 98 | 0.79 |
| 99 | 0.77 |
| 100 | 0.75 |

FIG. 5

| TEMPERATURE (°C) | CORRECTION VALUE (%) | CLOCK PULSE NUMBER |
|---|---|---|
| 0 | 0.463 | 1991 |
| 1 | 0.444 | 1991 |
| 2 | 0.426 | 1992 |
| ... | ... | ... |
| 25 | 0 | 2000 |
| ... | ... | ... |
| 45 | −0.37 | 1993 |
| 46 | −0.389 | 1992 |
| ... | ... | ... |
| 100 | −1.388 | 1972 |

IMAGE READING APPARATUS

BACKGROUND OF THE INVENTION

1. Field of the Invention

The present invention relates to an image reading apparatus, and more particularly to an image reading apparatus which controls conveyance of an original in accordance with the temperature of a conveyance roller for conveying the original, and performs appropriate conveyance by determining the presence of an abnormality in the temperature detection operation.

2. Description of the Background Art

An image reading apparatus for reading an original image, which is used in an image forming apparatus such as an electrophotographic copier, a facsimile apparatus, or a printer, may be of a stationary document/moving optical system type in which the original is fixed in position and scanned by exposure light, or a moving document/stationary optical system type in which the original is moved at a predetermined speed and the conveyed original is exposed to a fixed light source. An image reading apparatus may also be of an analog type used for typical image reading apparatuses or a digital type using an imaging apparatus such as a CCD (Charged Coupled Device). In recent years, digital moving document/stationary optical system type image reading apparatuses have come into wide use due to their effectiveness in reading large originals and executing various types of image processing thereon.

A moving document/stationary optical system image reading apparatus such as that disclosed in Japanese Unexamined Patent Application Publication 2002-284388, for example, typically employs an original conveyance mechanism in which a driven roller is pressed against a conveyance roller (rubber roller), which is driven to rotate by a drive motor, such that an original is conveyed between the conveyance roller and driven roller.

The drive motor which drives the conveyance roller to rotate typically employs a stepping motor, and the length of the original is calculated from the number of steps taken during reading of the original. More specifically, in a conventional original length calculation method, the original length is usually calculated by [number of clock pulses applied to move stepping motor during reading of original×distance by which original is conveyed per clock pulse of stepping motor] =[number of clock pulses applied to move stepping motor during reading of original×distance by which original is conveyed per clock pulse (=(angle by which conveyance roller rotates per clock pulse of stepping motor/360 degrees)×(2π× radius of conveyance roller))].

However, in the background art, variation in the original conveyance speed caused by variation in the temperature of the conveyance roller is not taken into account, and improvements are required to control the original conveyance speed accurately in order to achieve an improvement in the quality of the read image. More specifically, when the conveyance roller expands or contracts in the diametrical direction in accordance with its temperature, the conveyance speed of the conveyance roller varies from a preset conveyance speed, and as a result, the read image expands or contracts in accordance with the conveyance roller temperature, leading to deterioration of the image quality. In the background art, variation in the conveyance speed caused by the temperature of the conveyance roller is not taken into consideration.

Furthermore, in the background art the length of the original is calculated from the number of steps taken by a stepping motor during reading of the original, and therefore, when the temperature of the conveyance roller that is driven to rotate by the stepping motor to convey the original varies such that the conveyance roller expands or contracts in the diametrical direction, the distance by which the original is conveyed per step of the stepping motor changes, causing an error in the original length calculation result. This leads to a magnification ratio error which becomes particularly large in the case of an elongated original.

SUMMARY OF THE INVENTION

An object of the present invention is to provide an image reading apparatus which is capable of improving the image quality of a read image by conveying an original accurately and at a reasonable cost regardless of the temperature of a conveyance roller for conveying the original.

In accordance with the present invention, an image reading apparatus reads an image on an original using image reading means while conveying the original at a predetermined conveyance speed using a conveyance roller that is driven to rotate by a drive motor. The image reading apparatus comprises: a temperature detection device for detecting the temperature of the conveyance roller and outputting a predetermined detection signal; and a control device for performing original conveyance speed adjustment processing to adjust the conveyance speed at which the original is conveyed by the conveyance roller to a predetermined basic conveyance speed by controlling rotation of the drive motor on the basis of the detection signal of the temperature detection means.

BRIEF DESCRIPTION OF THE DRAWINGS

The above and other objects, features, and advantages of the present invention will become more apparent from the following detailed description taken with the accompanying drawings, in which:

FIG. 5 is a view showing an example of a correction table stored in the same non-volatile RAM.

DESCRIPTION OF THE PREFERRED EMBODIMENT

A preferred embodiment of the present invention will be described in detail below on the basis of the attached drawings.

Figure 1:
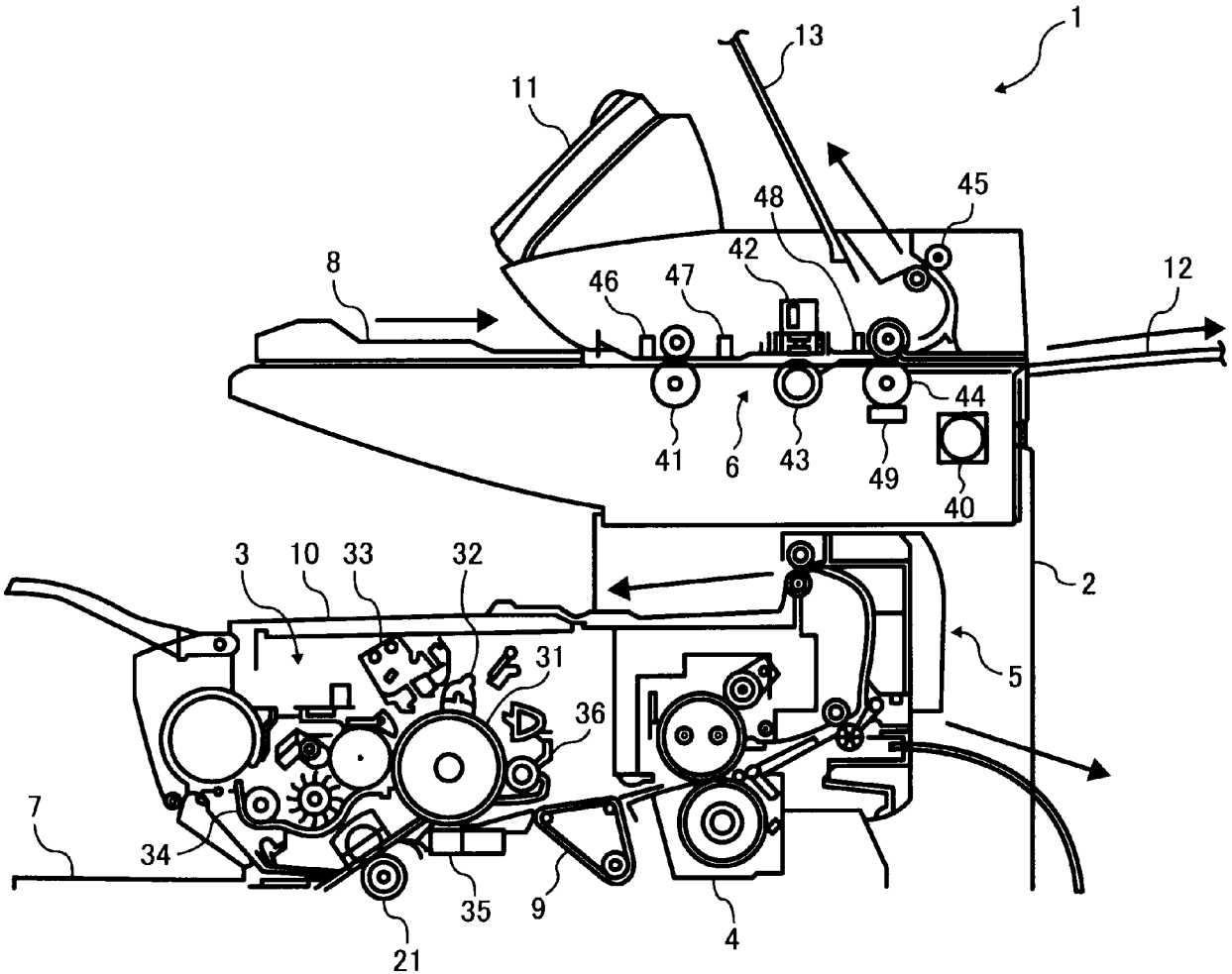
FIG. 1 is a view showing the schematic constitution of the main parts of a copying apparatus to which an embodiment of an image reading apparatus according to the present invention is applied.
Figure 2:
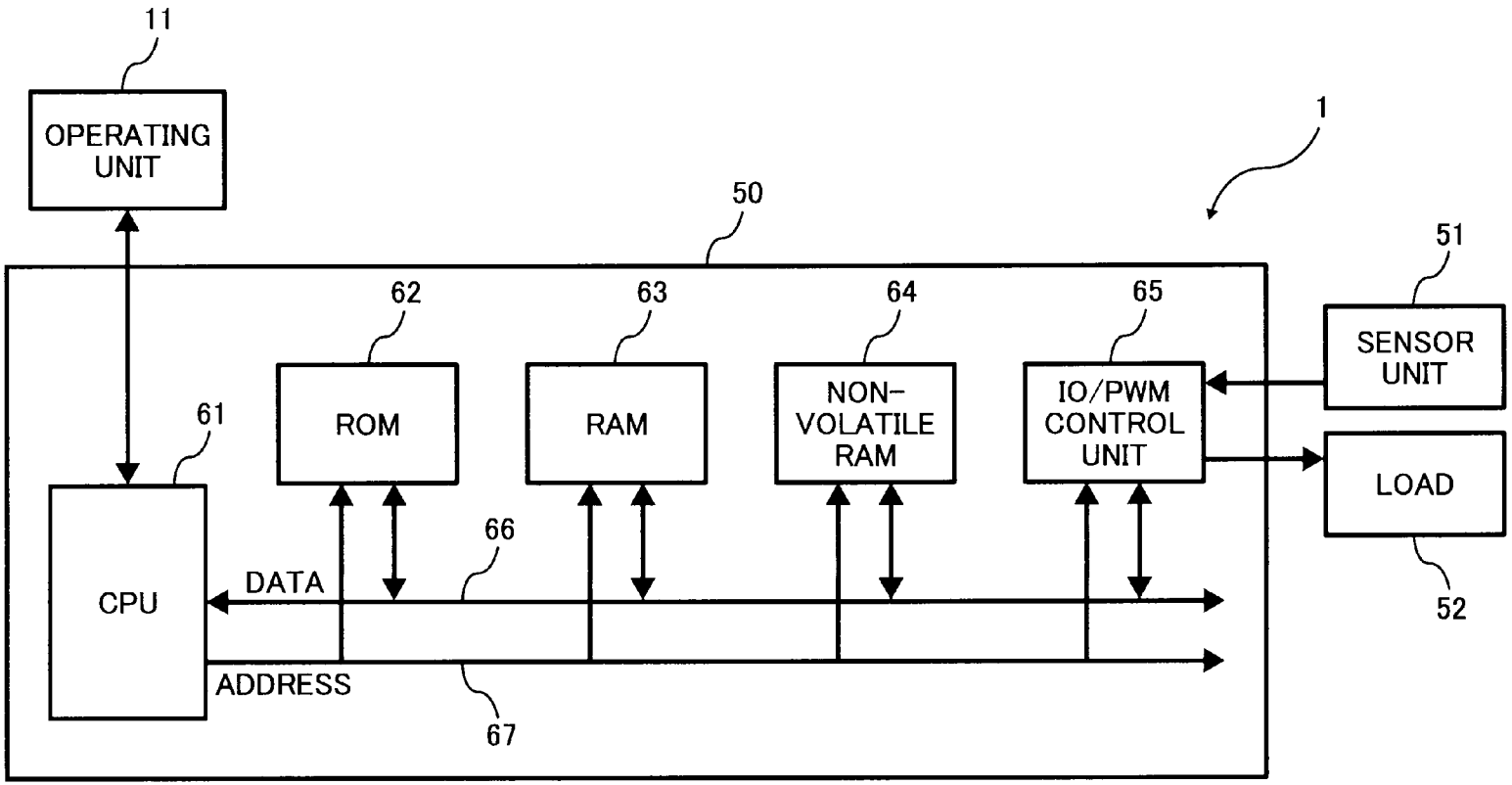
FIG. 2 is a block diagram showing the constitution of a control system of the copying apparatus shown in FIG. 1.
Figure 3:
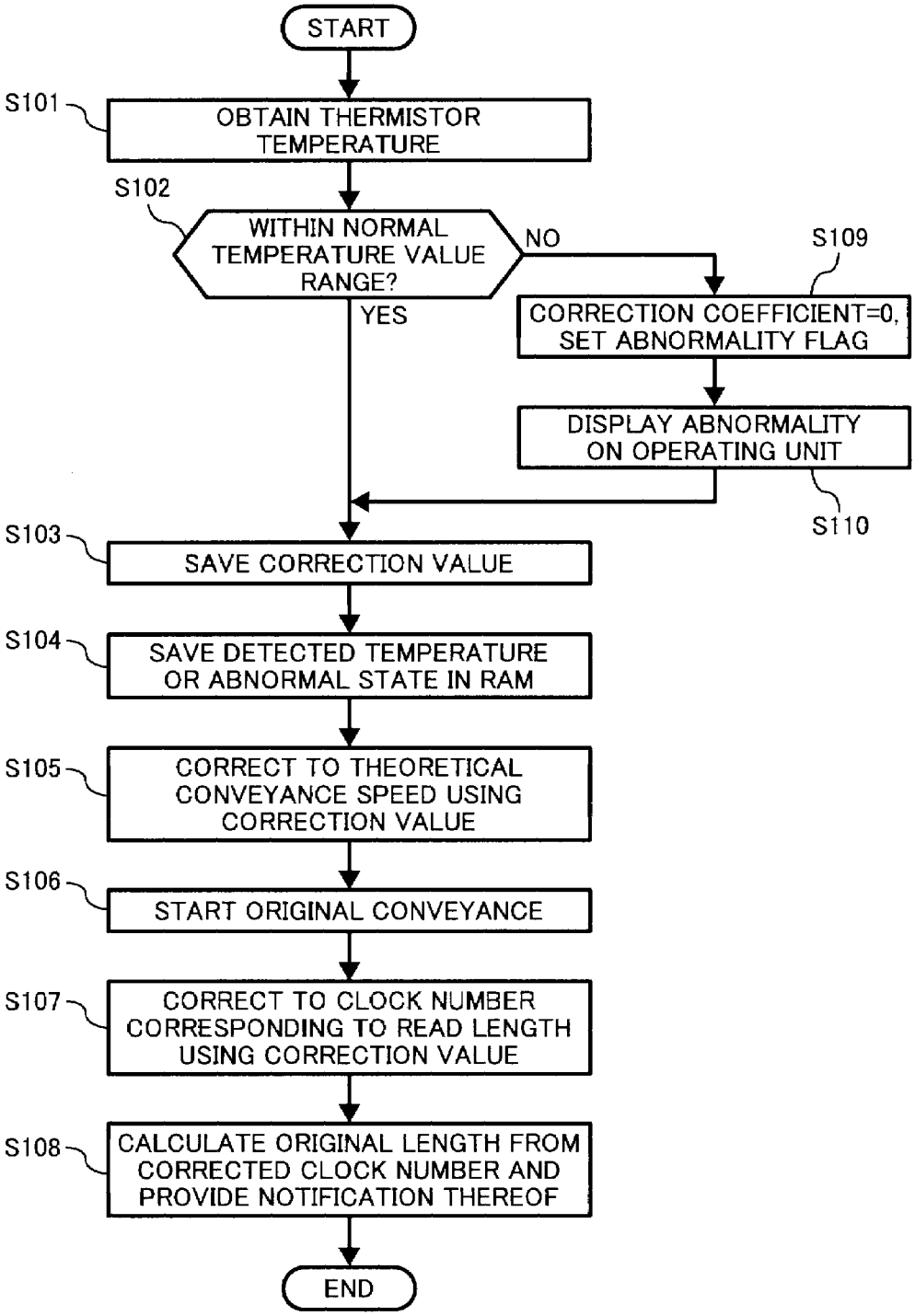
FIG. 3 is a flowchart showing original conveyance speed adjustment processing performed by the copying apparatus shown in FIG. 1.

Referring to FIGS. 1 to 3, a copying apparatus 1 serving as an example of an image reading apparatus according to this embodiment will be described.

In FIG. 1, an image forming unit 3, a fixing unit 4, a delivery unit 5, an image reading unit 6, a paper feeding unit not shown in the drawing, a conveyance unit not shown in the drawing, for conveying a sheet of recording paper from the paper feeding unit to the image forming unit 3, and so on are housed in a main body housing 2 of the copying apparatus 1. The copying apparatus 1 is also provided with a manual feeding tray 7, an original table 8, a recording paper conveyance unit 9, a delivery tray 10, an operating unit 11, and so on. Further, a delivery unit 12 is provided on the back surface side of the copying apparatus 1, and a duplex delivery unit 13 is provided on the upper portion of the copying apparatus 1.

A plurality of sheets of recording paper are set on the paper feeding unit. The conveyance unit comprises a resist roller 21 and so on, and at a timing regulated by the resist roller 21, an appropriate sheet of recording paper is conveyed from the paper feeding unit to the image forming unit 3. The conveyance unit also conveys a sheet of recording paper set on the manual feeding tray 7 to the image forming unit 3 at a timing regulated by the resist roller 21.

The image forming unit 3 comprises a charging unit 32, an optical writing unit 33, a development unit 34, a transfer unit 35, a cleaning unit 36, and so on, centered around a photosensitive body 31 which is driven to rotate in the counterclockwise direction of FIG. 1. The charging unit 32 employs a scorotron charger with a grid, for example, which charges the photosensitive body 31 uniformly (to −1200V, for example). In the image forming unit 3, the photosensitive body 31 that has been uniformly charged by the charging unit 32 is irradiated with light by the optical writing unit 33, this light being illumination-controlled on the basis of original image data read by the image reading unit 6 and image data obtained by expanding printer driver data input from an external apparatus, not shown in the drawing, which is connected via an interface circuit such as a LAN (Local Area Network), for example. As a result, the surface charge of the irradiated parts of the photosensitive body 31 is earthed by a photoconduction phenomenon and extinguished, whereby an electrostatic latent image is formed. The development unit 34 then adheres toner to the photosensitive body 31 formed with the electrostatic latent image to form a toner image. More specifically, the toner in the development unit 34 is charged negatively through agitation, and a bias of −700V, for example, is applied such that toner is adhered only to the irradiated parts.

In the image forming unit 3, the toner image formed on the photosensitive body 31 is transferred onto the recording paper conveyed from the paper feeding unit by the transfer unit 35, and once transfer is complete, the recording paper is conveyed to the fixing unit 4 by the recording paper conveyance unit 9. Also in the image forming unit 3, residual toner on the photosensitive body 31 is cleaned by the cleaning unit 36 when transfer is complete, whereupon the cleaned photosensitive body 31 is neutralized by a neutralizing unit, not shown in the drawing, and then charged uniformly by the charging unit 32 in preparation for the next image formation operation.

The fixing unit 4 comprises a heating roller which is heated to a predetermined fixing temperature, and a pressure roller which is pressed against the heating roller. The recording paper formed with the toner image, which is conveyed from the image forming unit 3 by the recording paper conveyance unit 9, is heated and pressed while being conveyed such that the toner image is fixed onto the recording paper. Once fixing is complete, the recording paper is discharged to the delivery unit 5. The delivery unit 5 discharges the fixed recording paper onto the delivery tray 10.

The image reading unit 6 comprises a stepping motor 40, an inlet conveyance roller 41, a contact sensor 42, a white roller 43 disposed opposite the contact sensor 42, an outlet conveyance roller 44, a discharge roller 45, an insertion sensor 46, an original length sensor 47, a delivery sensor 48, a contact-type temperature detection sensor 49 for detecting the temperature of the outlet conveyance roller 44, and so on.

When an original set on the original table 8 is inserted into the original reading unit 6, the original is detected by the insertion sensor 46, and when the tip end of the original abuts against the inlet conveyance roller 41, the original is straightened. Following a predetermined time period after detection by the insertion sensor 46, the original is conveyed between the contact sensor 42 and white roller 43 by the inlet conveyance roller 41. When the tip end of the original is conveyed to the position of the original length sensor 47 in the image reading unit 6, the output of the original length sensor 47 varies, and when the rear end of the original moves past the original length sensor 47, the output of the original length sensor 47 varies again.

In the image reading unit 6, the length of the original is detected by counting a number of clock pulses (steps) supplied to the stepping motor 40, which drives the inlet conveyance roller 41, outlet conveyance roller 44, discharge roller 45, and so on, during the period lasting from detection of the tip end of the original to detection of the rear end of the original by the original length sensor 47. A signal indicating the original length detected by the original length sensor 47 is input into an image processing unit, not shown in the drawing, and also used as a sub-scanning direction effective area signal. After being conveyed between the contact sensor 42 and white sensor 43 by the inlet conveyance roller 41 in the image reading unit 6, the original is conveyed further so as to be held by the outlet conveyance roller 44. Thereafter, the original is mainly conveyed by the outlet conveyance roller 44.

The image reading unit 6 reads the image on the original by subjecting the original to main scanning and sub-scanning using the contact sensor 42 while the original is conveyed by the white roller 43, inlet conveyance roller 41, and outlet conveyance roller 44. More specifically, the original is irradiated with reading light from a light source (an LED, for example) of the contact sensor 42, whereupon the reflection light, including image information, that is reflected by the original is subjected to photoelectric conversion and outputted as an analog image signal.

When the original has been read in the image reading unit 6, the original is discharged onto an original delivery tray 17 by the outlet conveyance roller 44. A double-sided original or the like is discharged to the duplex delivery unit 13 by the discharge roller 45. Note that the white roller 43 is used during shading correction to correct irregularities caused by illumination unevenness, unevenness in the sensitivity of each pixel in the contact sensor 42, and so on. The copying apparatus 1 performs shading correction using data output by the contact sensor 42 when the white roller 43 is read as shading data (white reference data).

The temperature detection sensor (temperature detection means) 49 detects the temperature of the outlet conveyance roller 44 by contacting the surface of the outlet conveyance roller 44, and outputs a detection result. A thermistor, for example, is used as the temperature detection sensor 49, and the temperature is detected by dividing a voltage (5V) supplied by the copying apparatus 1 using the thermistor serving as the temperature detection sensor 49 and a fixed resistance, and detecting variation in the divided voltage, which is caused by variation in the resistance value of the thermistor according to the temperature, using an ADC (Analog to Digital Converter)

The white roller 43, inlet conveyance roller 41, and outlet conveyance roller 44 are driven to rotate by a drive motor, not shown in the drawing, such as the stepping motor 40, for example, and serve to convey the original during original reading. Where necessary hereafter, the white roller 43, inlet conveyance roller 41, and outlet conveyance roller 44 will be referred to collectively as an original conveyance roller.

The operating unit 11 comprises operating keys such as a numeral pad and a start key, various function keys and the like, and a display (for example, a liquid crystal display), LED (Light Emitting Diode), and so on serving as display means and notification means. Various commands such as a copy operation are input through the operating keys. The display displays the content of a command input through the operating keys, the content of the operation, and various information provided to an operator from the copying apparatus 1, in particular various information required for original conveyance speed adjustment processing to be described below.

As shown in FIG. 2, a control system of the copying apparatus 1 is constituted by a circuit block comprising the aforementioned operating unit 11, a control unit 50, a sensor unit 51, various loads 52, and so on. The control unit 50 comprises a CPU (Central Processing Unit) 61, ROM (Read Only Memory) 62, RAM (Random Access Memory) 63, non-volatile RAM 64, an IO/PWM control unit 65, and so on. The CPU 61, ROM 62, RAM 63, non-volatile RAM 64, and IO/PWM control unit 65 are connected by a data bus 66 and an address bus 67.

The ROM 62 stores a basic program of the copying apparatus 1 and various programs such as an original conveyance speed adjustment processing program to be described below, as well as various data required to execute these programs. The RAM 63 is used as a working memory of the CPU 61. The CPU (control means) 61 controls the various units of the copying apparatus 1 using the RAM 63 as a working memory on the basis of the programs stored in the ROM 62, and executes the basic processing of the copying apparatus 1 as well as the original conveyance speed adjustment processing to be described below.

The non-volatile RAM (adjustment table storage means, abnormality determination data storage means) 64 stores adjustment values relating to control, timing, and so on, as well as various data that must be stored when the power source of the copying apparatus 1 is OFF, for example a recorded mode setting. In particular, the non-volatile RAM 64 stores table data used in the original conveyance speed adjustment processing to be described below and various data used in the original conveyance speed adjustment processing.

The sensor unit 51 is a collective name for the insertion sensor 46, original length sensor 47, delivery sensor 48, and temperature detection sensor 49 of the image reading unit 6, and the various sensors of the image forming unit 3, fixing unit 4, delivery unit 5, and so on. Detection signals from the various sensors constituting the sensor unit 51 are input into the CPU 61 via the IO/PWM control unit 65.

The load 52 is a collective name for the loads of various actuators, motors, and soon. In particular, the load 52 includes the stepping motor 40 which drives rollers such as the inlet conveyance roller 41, white roller 43, outlet conveyance roller 44, and discharge roller 45 of the image reading unit 6.

The IO/PWM control unit 65 transfers a detection signal from the sensor unit 51 to the CPU 61, and outputs a PWM (Pulse Width Modulation) signal for driving a motor from the CPU 61 to the load 52.

The copying apparatus 1 adjusts the conveyance speed of the original based on the temperatures of the inlet conveyance roller 41, white roller 43, and outlet conveyance roller 44, i.e. the original conveyance roller for conveying the original during original reading, and in particular the temperature of the outlet conveyance roller 44. More specifically, during conveyance of the original, the outlet conveyance roller 44 conveys the original while stretching the original slightly to prevent creases or the like from forming, and since the outlet conveyance roller 44 is mainly responsible for conveying the original, the conveyance speed of the original is adjusted on the basis of the temperature of the outlet conveyance roller 44.

To describe original conveyance speed adjustment specifically, when the original conveyance roller is driven to rotate by the stepping motor 40, a reference number of steps applied to the stepping motor 40 during conveyance of the original at a reference conveyance speed is set in advance at a reference temperature. The temperature of the outlet conveyance roller 44 is then detected by the temperature detection sensor 49, and on the basis of the temperature detected by the temperature detection sensor 49, the reference step number is corrected (adjusted) by referring to a preset correction table showing the temperature of the outlet conveyance roller 44 and the conveyance speed (step number), which is stored in the non-volatile RAM 64. The stepping motor 40 is then driven to rotate at the corrected step number.

For example, when the reference temperature of the copying apparatus 1 is set at 25° C., which is a standard use environment for the copying apparatus 1, the original is conveyed 0.05 mm for every clock pulse (step) applied to the stepping motor 40 at this standard temperature, and hence, to realize a linear copying speed of 100 mm/sec, the stepping motor 40 is driven at 2000 clock pulses (steps) per second, whereby the original is conveyed at a 100% magnification ratio.

The detected temperature (detection signal) output by the temperature detection sensor 49 may indicate an abnormal value. More specifically, an abnormal value may be output when the surface temperature of the outlet conveyance roller 44 is abnormal, and when the temperature detection sensor 49 has become disconnected or suffered a short-circuit or the like. If the rotation speed of the stepping motor 40 is corrected on the basis of the detection signal from the temperature detection sensor 49 when the temperature detection sensor 49 outputs such an abnormal value as a detection signal, the rotation speed of the stepping motor 40, or in other words the rotation speed of the outlet conveyance roller 44, becomes abnormal, and appropriate image reading cannot be performed. Moreover, it may become impossible to protect the copying apparatus 1 from malfunctions or the like.

Hence, in the copying apparatus 1 of this embodiment, normal value range data (abnormality determination data) relating to the detection signal of the temperature detection sensor 49 are stored in advance in the non-volatile RAM 64 serving as abnormality determination data storage means so that when the detection signal from the temperature detection sensor 49 deviates from detection values within a predetermined range, the presence of an abnormality in the detection signal caused by an abnormality in the temperature detection sensor 49 or the like is determined. When a thermistor is used as the temperature detection sensor 49, for example, the temperature is detected as voltage variation caused by temperature-related variation in the resistance value of the thermistor, as described above. Accordingly, a voltage-temperature table (see FIG. 4A) illustrating the relationship between the voltage variation output by the temperature detection sensor 49 and the temperature of the outlet conveyance roller 44 is stored in the non-volatile RAM 64, and the CPU 61 determines the detected temperature from the voltage value serving as the detection signal of the temperature detection sensor 49.

Figures 4A, 4B:
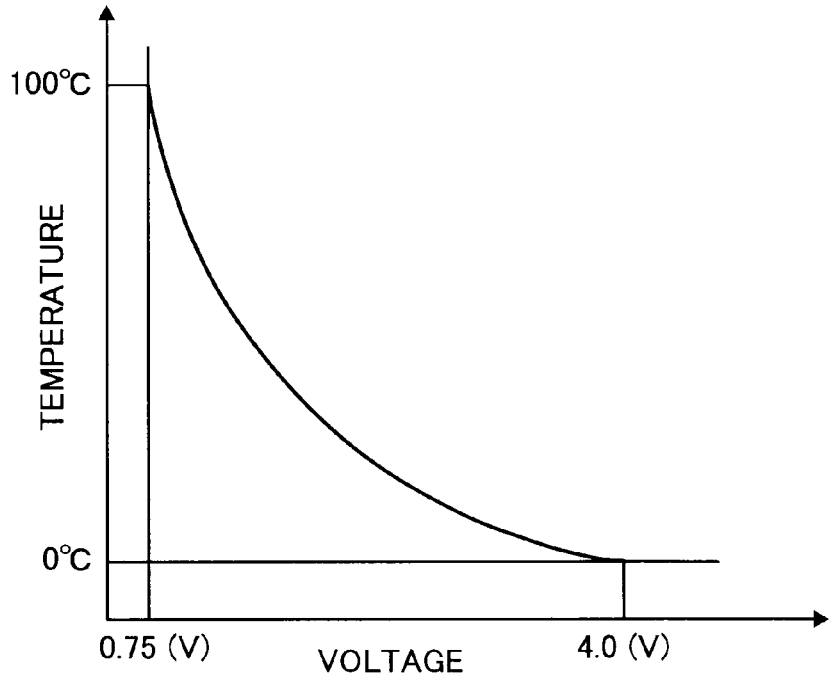
FIG. 4A is a table showing an example of a voltage-temperature relationship stored in a non-volatile RAM of the control system shown in FIG. 2.
FIG. 4B is a characteristic diagram showing the same voltage-temperature relationship.

The voltage and temperature are related in the manner shown in FIG. 4B. The outlet conveyance roller 44 does not fall below 0° C. or exceed 100° C. under normal use conditions, and hence a range of 0° C. to 100° C. is set as a normal range. When the temperature of the outlet conveyance roller 44 is 0° C., the voltage value output by the temperature detection sensor 49 is 4.0V, and at 100° C., the voltage value output by the temperature detection sensor 49 is 0.75V. Using these values as the abnormality determination data, the CPU 61 determines that the detected voltage of the temperature detection sensor 49 is within the normal range when between 0.75 and 4.0V. Conversely, when the detected voltage of the temperature detection sensor 49 deviates from the range of 0.75 to 4.0V, the CPU 61 determines that the detected voltage is in an abnormal range. For example, when the thermistor serving as the temperature detection sensor 49 suffers a short-circuit, the power source voltage (5V) itself is output as the detection signal of the temperature detection sensor 49, and when the thermistor is open, 0V is output as the detection signal of the temperature detection sensor 49. In these cases, the CPU 61 is able to determine the presence of an abnormality in the temperature detection mechanism by assessing the detected voltage of the temperature detection sensor 49.

Next, the actions of this embodiment will be described.

The copying apparatus 1 of this embodiment corrects (adjusts) the conveyance speed of the outlet conveyance roller 44 for conveying the original to a constant speed by controlling the rotation speed of the stepping motor 40, which drives the outlet conveyance roller 44, appropriately in accordance with the temperature of the outlet conveyance roller 44. The aforementioned voltage-temperature table, a correction coefficient table, and the normal value range data are stored in advance in the non-volatile RAM 64 of the copying apparatus 1.

In this state, the original set on the original table 8 is detected by the insertion sensor 46. Then, a scan mode for reading the original using the operating unit 11 or a copy mode for copying the image on the original is selected, and other reading conditions and so on a reset. Next, a start key is pressed, whereupon the CPU 61 controls the various units to drive the stepping motor 40 such that the inlet conveyance roller 41, white roller 43, and outlet conveyance roller 44 are driven to rotate. The original image is then read by the contact sensor 42 while being conveyed, and the original length is calculated from the tip end and rear end of the original, detected by the original length sensor 47, and the number of clock pulses supplied to the stepping motor 40.

As shown in FIG. 3, during the original reading operation described above, the CPU 61 obtains a temperature from the thermistor serving as the temperature detection sensor 49 for detecting the temperature of the outlet conveyance roller 44 which conveys the original (step S101). More specifically, the CPU 61 determines the temperature of the outlet conveyance roller 44 from the detected voltage serving as the detection signal of the thermistor constituting the temperature detection sensor 49 by referring to the voltage-temperature table stored in the non-volatile RAM 64 shown in FIG. 4A.

Having detected the temperature of the outlet conveyance roller 44, the CPU 61 checks whether or not the temperature of the outlet conveyance roller 44 is within a preset normal temperature range, which is stored in the non-volatile RAM 64, on the basis of the normal value range data shown in FIG. 4B (step S102). A range of 0° C. to 100° C., for example, is set as the normal temperature range, and in this embodiment, the determination as to whether or not the temperature of the outlet conveyance roller 44 is within the normal range is performed only once, at the start of the reading operation.

When the temperature of the outlet conveyance roller 44 is determined to be within the normal temperature range in the step S102, the CPU 61 refers to a correction table (adjustment table; see FIG. 5) stored in the non-volatile RAM 64 serving as adjustment table storage means to determine a correction value for correcting variation in the conveyance speed of the outlet conveyance roller 44, which is caused by temperature variation from a basic temperature, by adjusting the number of steps taken by the stepping motor 40 which drives the outlet conveyance roller 44, and saves the determined correction value in the non-volatile RAM 64 (step S103). The correction value may be determined according to the following Equation (1).

$$\text{correction value \%} = (\text{temperature difference}) \times (\text{variation coefficient \% per } 1^\circ \text{ C. variation}) \quad \text{Eq (1)}$$

The temperature difference is the difference between the basic temperature of the outlet conveyance roller 44 and the detected temperature determined from the detected voltage of the temperature detection sensor 49, and equals [basic temperature−detected temperature]. When the detected temperature is 25° C. or greater, the temperature difference takes a negative value, and when the detected temperature is less than 25° C., the temperature difference takes a positive value. More specifically, when the temperature rises, the diameter of the outlet conveyance roller 44 increases, leading to an increase in the conveyance speed, and therefore, in order to raise the magnification ratio such that the conveyance speed falls, the correction value is subtracted from the set magnification ratio and the correction value is set at a negative value such that the magnification ratio becomes greater than the set magnification ratio. Conversely, when the temperature falls below the reference temperature, the diameter of the outlet conveyance roller 44 decreases and the conveyance speed falls, and therefore, in order to lower the magnification ratio such that the conveyance speed rises, the correction value is subtracted from the set magnification ratio and the correction value is set at a positive value such that the magnification ratio becomes smaller than the set magnification ratio.

The variation coefficient is a value measured in advance using a simulator or the like in accordance with the following Equation (2) or the like, which is stored in advance in the non-volatile RAM 64 in the forming a variation coefficient table (correction table).

$$(\text{distance advanced per clock pulse of stepping motor 40 at basic temperature})/(\text{distance advanced per clock pulse of stepping motor 40 when temperature rises } 1^\circ \text{ C. beyond basic temperature}) \quad \text{Eq (2).}$$

In this embodiment, the variation coefficient is 0.0185 (%/° C.).

In other words, having determined the difference between the basic temperature and the detected temperature determined from the detected voltage of the temperature detection sensor 49, the CPU 61 determines the correction value calculated using Equation (1) on the basis of the variation coefficient determined in advance using Equation (2), and saves the determined correction value in the non-volatile RAM 64.

After saving the detected temperature determined from the detected voltage (detection signal) of the temperature detection sensor 49 in the non-volatile RAM 64 (step S104), the CPU 61 uses the correction value saved in the step S103 to correct the number of clock pulses applied to the stepping motor 40 to a clock pulse number (corrected clock pulse number) which changes the conveyance speed of the outlet conveyance roller 44, the temperature of which has varied from the basic temperature, to a theoretical original conveyance speed at basic temperature (basic original conveyance speed), on the basis of the correction table shown in FIG. 5 (step S105).

More specifically, the original conveyance speed differs according to a magnification ratio specified by an operator using the operating unit 11, and by subtracting the correction value from the specified magnification ratio, the original can be conveyed at a speed corresponding to the corrected magnification ratio. Hence, the original conveyance speed can be set independently of expansion and contraction according to the temperature of the original conveyance roller including the outlet conveyance roller 44.

Having calculated the corrected clock pulse number, the CPU 61 applies the corrected clock pulse number to the stepping motor 40 and drives the original conveyance roller, including the outlet conveyance roller 44, to begin conveying the original (step S106). Once original conveyance has begun, the original length is calculated from the clock pulse number applied to the stepping motor 40 between the tip end and rear end of the original, which are detected by the original length sensor 47, and the calculated original length is output for display on the display of the operating unit 11 (steps S107, S108).

In other words, when the temperature of the outlet conveyance roller 44 corresponds to the basic temperature, the original length can be calculated on the basis of the following Equation (3).

basic original length=(clock pulse number applied to stepping motor 40 from ON to OFF of original length sensor 47) ×(original conveyance distance per clock pulse of stepping motor 40)×(specified magnification ratio) Eq (3)

However, when the temperature of the outlet conveyance roller 44 varies from the basic temperature, the original conveyance distance per clock pulse of the stepping motor 40 varies, and therefore variation in the original length caused by the variation in the temperature of the outlet conveyance roller 44 is corrected by correcting Equation (3) to the following Equation (4).

corrected original length=(clock pulse number applied to stepping motor 40 from ON to OFF of original length sensor 47)×(original conveyance distance per clock pulse of stepping motor 40)×(specified magnification ratio−correction value) Eq (4)

Having calculated the original length in the manner described above, the CPU 61 notifies the operator of the calculated original length by outputting the calculated original length for display on the display of the operating unit 11, and when the copy mode has been set, the CPU 61 also notifies the image forming unit 3 of the calculated original length for use in image formation (step S108). As a result, temperature-related magnification ratio errors are prevented from occurring, and since the image formed by the image forming unit 3 can be based on an accurate original length, accurate image formation can be performed.

When it is determined in the step S102 that the temperature of the outlet conveyance roller 44 is outside of the normal temperature range, the CPU 61 sets the correction value to "0" and sets an abnormality flag (step S109). A message indicating an abnormality is displayed on the display of the operating unit 11 and/or notification of the abnormality is provided by causing the LED or the like of the operating unit 11 to illuminate or flash (step S110). Further, an abnormal state is saved in the non-volatile RAM 64 (step S104).

When the abnormality flag has been set, the CPU 61 begins normal original conveyance (step S106) without adjusting the conveyance speed (performing original conveyance speed adjustment processing) by correcting the clock pulse number applied to the stepping motor 40 in accordance with the temperature detection sensor 49. An uncorrected original length is determined and output for display on the display of the operating unit 11 to notify the operator thereof, and when the copy mode has been set, the image forming unit 3 is notified of the uncorrected original length for use in image formation (step S108).

As a result, image formation can be performed appropriately by the image forming unit 3 without being affected by the abnormality detection of the temperature detection sensor 49.

Note that in the above description, the stepping motor 40 is used as a drive motor for conveying the original, but the drive motor is not limited to a stepping motor. Also in the above description, the number of clock pulses supplied per unit time is corrected, but the present invention is not limited to this example.

Hence in the copying apparatus 1 of this embodiment, the temperature of the outlet conveyance roller 44 for conveying the original, which is driven to rotate by the stepping motor 40 serving as a drive motor, is detected by the temperature detection sensor 49, and the number of clock pulses supplied to the stepping motor 40 is corrected on the basis of the detection signal from the temperature detection sensor 49. The rotation of the stepping motor 40 is controlled on the basis of the corrected clock pulse number, whereby the speed at which the original is conveyed by the outlet conveyance roller 44 is adjusted to a predetermined basic conveyance speed. Accordingly, the conveyance speed of the outlet conveyance roller 44 can be adjusted to the basic conveyance speed by controlling the rotation of the stepping motor 40 which drives the outlet conveyance roller 44 even when the size of the outlet conveyance roller 44 in the diametrical direction varies due to temperature variation. Therefore, the original can be conveyed at an accurate conveyance speed even when an elongated original, for example, is conveyed, and as a result, the image quality of the read image can be improved.

Also in the copying apparatus 1 of this embodiment, a correction table, which is an adjustment table illustrating the relationship between the temperature of the outlet conveyance roller 44 and the original conveyance speed, is stored in the non-volatile RAM 64, and the CPU 61 controls the stepping number of the stepping motor 40 by referring to the correction table in the non-volatile RAM 64 on the basis of the temperature of the outlet conveyance roller 44, which is indicated by the detection signal of the temperature detection sensor 49. Hence, speed control processing can be performed quickly and easily, and the original can be conveyed at an accurate conveyance speed while increasing the processing speed of image reading processing, leading to an improvement in the image quality of the read image.

Furthermore, in the copying apparatus 1 of this embodiment, abnormality determination data for determining the presence of an abnormality in the detection signal of the temperature detection means are stored in the non-volatile RAM 64 as normal value range data, and the CPU 61 determines the presence or absence of an abnormality in the detection signal by comparing the detection signal of the temperature detection sensor 49 to the normal value range data in the non-volatile RAM 64. When it is determined that an abnormality is present, notification of the presence of the abnormality in the detection signal is output for display on the display of the operating unit 11, and/or the presence of the abnormality in the detection signal is indicated by causing the LED or the like on the operating unit 11 to illuminate or flash. Hence, when a short-circuit, disconnection, or other abnormality occurs in the temperature detection mechanism, including the temperature detection sensor 49, notification of the abnormality in the detection signal can be provided appropriately, and defective image reading operations such as copy errors can be eliminated.

Further, in the copying apparatus 1 of this embodiment, when the CPU 61 determines the presence of an abnormality in the detection signal of the temperature detection sensor 49, original conveyance speed adjustment processing based on the detection signal of the temperature detection sensor 49 is rendered invalid. Hence, abnormalities in the read image, malfunctions of the original conveyance system, and soon caused when the original conveyance speed is adjusted on the basis of an abnormal detected temperature can be forestalled, and therefore safety can be assured.

Further, in the copying apparatus 1 of this embodiment, when the CPU 61 performs original conveyance speed adjustment processing, a correction value, which is an adjustment value of the original conveyance speed adjusted during the original conveyance speed adjustment processing, is output for display on the display of the operating unit 11 together with the detected temperature of the outlet conveyance roller 44. Hence, an operator or service person of the copying apparatus 1 can easily check the state of the copying apparatus 1 so that when a read image or a copied recorded image expands or contracts, for example, it is easy to determine whether or not the processing result of the original conveyance speed adjustment processing is the cause of the image expansion or contraction, there by facilitating maintenance of the copying apparatus 1 and so on.

According to the image reading apparatus of the present invention, the temperature of a conveyance roller for conveying an original, which is driven to rotate by a drive motor, is detected by temperature detection means, and original conveyance speed adjustment processing to adjust the speed at which the original is conveyed by the conveyance roller to a basic conveyance speed is performed by controlling the rotation of the drive motor on the basis of a detection signal from the temperature detection means. Hence, even when the size of the conveyance roller in the diametrical direction varies due to temperature variation, the conveyance speed of the conveyance roller can be adjusted to the basic conveyance speed by controlling the rotation of the drive motor which drives the conveyance roller, and therefore the original can be conveyed at an appropriate conveyance speed even when an elongated original, for example, is conveyed, enabling an improvement in the image quality of the read image.

Various modifications will become possible for those skilled in the art after receiving the teachings of the present disclosure without departing from the scope thereof. For example, the present invention maybe applied to an image reading apparatus which reads an original image while conveying the original by having a drive motor drive an original conveyance roller, and a copying apparatus, facsimile apparatus, compound apparatus, or similar which is equipped with the image reading apparatus.

What is claimed is:

1. An image reading apparatus for reading an image on an original using image reading means while conveying said original at a predetermined conveyance speed using a conveyance roller that is driven to rotate by a drive motor, said image reading apparatus comprising:

temperature detection means for detecting a conveyance-roller temperature of said conveyance roller and outputting a predetermined detection signal; and control means for performing original conveyance speed adjustment processing to adjust said conveyance speed at which said original being read is conveyed by said conveyance roller to a predetermined basic conveyance speed by controlling the rotation of said drive motor on the basis of said detection signal from said temperature detection means, wherein the speed of said conveyance roller is adjusted based on a difference between a reference temperature of said conveyance roller and the detected conveyance-roller temperature in accordance with a variation coefficient value, said variation coefficient value being determined based on a distance said original is advanced per clock pulse by the drive motor at the reference temperature and a distance said original is advanced per clock pulse by the drive motor when the temperature rises by 1° C. beyond the reference temperature.

2. The image reading apparatus as claimed in claim 1, further comprising predetermined display means, wherein said control means, upon performing said original conveyance speed adjustment processing, outputs an adjustment value of said original conveyance speed corrected during said original conveyance speed adjustment processing, and said detected temperature of said conveyance roller, for display on said display means.

3. The image reading apparatus as claimed in claim 1, further comprising:

abnormality determination data storage means for storing abnormality determination data for determining the presence or absence of an abnormality in said detection signal of said temperature detection means; and predetermined notification means, wherein said control means determines the presence or absence of an abnormality in said detection signal by comparing said detection signal of said temperature detection means to said abnormality determination data stored in said abnormality determination data storage means, and having determined the presence of an abnormality, said control means outputs notification of said abnormality in said detection signal of said temperature detection means to said notification means.

4. The image reading apparatus as claimed in claim 3, wherein said control means, having determined the presence of an abnormality in said detection signal of said temperature detection means, invalidates said original conveyance speed adjustment processing based on said detection signal of said temperature detection means.

5. The image reading apparatus as claimed in claim 4, further comprising predetermined display means, wherein said control means, upon performing said original conveyance speed adjustment processing, outputs an adjustment value of said original conveyance speed corrected during said original conveyance speed adjustment processing, and said detected temperature of said conveyance roller, for display on said display means.

6. The image reading apparatus as claimed in claim 1, further comprising adjustment table storage means for storing an adjustment table illustrating a relationship between said temperature of said conveyance roller and said conveyance speed of said original, wherein said control means controls the rotation of said drive motor as said original conveyance speed adjustment processing by referring to said adjustment table stored in said adjustment table storage means on the basis of said temperature of said conveyance roller indicated by said detection signal of said temperature detection means.

7. The image reading apparatus as claimed in claim 6, further comprising:

abnormality determination data storage means for storing abnormality determination data for determining the presence or absence of an abnormality in said detection signal of said temperature detection means; and predetermined notification means, wherein said control means determines the presence or absence of an abnormality in said detection signal by comparing said detection signal of said temperature detection means to said abnormality determination data stored in said abnormality determination data storage means, and having determined the presence of an abnormality, said control means outputs notification of said abnormality in said detection signal of said temperature detection means to said notification means.

8. The image reading apparatus as claimed in claim 7, wherein said control means, having determined the presence of an abnormality in said detection signal of said temperature detection means, invalidates said original conveyance speed adjustment processing based on said detection signal of said temperature detection means.

9. The image reading apparatus as claimed in claim 8, further comprising predetermined display means, wherein said control means, upon performing said original conveyance speed adjustment processing, outputs an adjustment value of said original conveyance speed corrected during said original conveyance speed adjustment processing, and said detected temperature of said conveyance roller, for display on said display means.

10. An image reading apparatus configured to read an image on an original using an image reading unit while conveying said original at a predetermined conveyance speed using a conveyance roller that is driven to rotate by a drive motor, said image reading apparatus comprising:

a temperature detection sensor configured to detect a conveyance-roller temperature of said conveyance roller and to output a predetermined detection signal; and a control unit configured to perform original conveyance speed adjustment processing to adjust said conveyance speed at which said original being read is conveyed by said conveyance roller to a predetermined basic conveyance speed by controlling the rotation of said drive motor on the basis of said detection signal from said temperature detection unit, wherein the speed of said conveyance roller is adjusted based on a difference between a reference temperature of said conveyance roller and the detected conveyance-roller temperature in accordance with a variation coefficient value, said variation coefficient value being determined based on a distance said original is advanced per clock pulse by the drive motor at the reference temperature and a distance said original is advanced per clock pulse by the drive motor when the temperature rises by 1° C. beyond the reference temperature.

11. The image reading apparatus according to claim 1, wherein the temperature detection means provides said detection signal to said control means such that the conveyance speed is adjusted to compensate for a change in a diameter of the conveyance roller.

12. The image reading apparatus according to claim 1, wherein an operating temperature range of said conveyance roller is between 0° C. and 100° C.

13. The image reading apparatus according to claim 1, wherein a magnification ratio to read said original is increased from a set magnification ratio when the temperature of said conveyance roller is detected to have increased; and the magnification ratio to read said original is decreased from the set magnification ratio when the temperature of said conveyance roller is detected to have decreased.

14. The image reading apparatus according to claim 10, wherein the temperature detection unit provides said detection signal to said control unit such that the conveyance speed is adjusted to compensate for a change in a diameter of the conveyance roller.

15. The image reading apparatus according to claim 10, wherein an operating temperature range of said conveyance roller is between 0° C. and 100° C.

16. The image reading apparatus according to claim 10, wherein a magnification ratio to read said original is increased from a set magnification ratio when the temperature of said conveyance roller is detected to have increased; and the magnification ratio to read said original is decreased from the set magnification ratio when the temperature of said conveyance roller is detected to have decreased.

* * * * *